US010830243B2

(12) United States Patent
Chen

(10) Patent No.: US 10,830,243 B2
(45) Date of Patent: Nov. 10, 2020

(54) ILLUMINATION FAN

(71) Applicant: COOLER MASTER TECHNOLOGY INC., New Taipei (TW)

(72) Inventor: Chen-Wei Chen, New Taipei (TW)

(73) Assignee: COOLER MASTER TECHNOLOGY INC., New Taipei (TW)

( * ) Notice: Subject to any disclaimer, the term of this patent is extended or adjusted under 35 U.S.C. 154(b) by 284 days.

(21) Appl. No.: 15/966,954

(22) Filed: Apr. 30, 2018

(65) Prior Publication Data

US 2019/0331122 A1 Oct. 31, 2019

(51) Int. Cl.

| | |
|---|---|
| ***F04D 25/06*** | (2006.01) |
| ***F04D 25/08*** | (2006.01) |
| ***F04D 29/38*** | (2006.01) |
| *F21Y 115/10* | (2016.01) |

(52) U.S. Cl.

CPC ..... *F04D 25/0613* (2013.01); *F04D 25/08* (2013.01); *F04D 29/388* (2013.01); *F21Y 2115/10* (2016.08)

(58) Field of Classification Search

CPC ..... H05K 7/20172; F04D 25/0613; F04D 29/005; F04D 29/00; F04D 25/08; F21V 33/0052; F21V 33/0096; F21V 23/005; G06F 1/20; F21Y 2103/33; F21Y 2107/10; F21Y 2115/10

See application file for complete search history.

(56) References Cited

U.S. PATENT DOCUMENTS

| | | | | |
|---|---|---|---|---|
| 7,261,431 | B2 * | 8/2007 | Huang | F04D 25/0613 362/656 |
| 9,506,663 | B2 | 11/2016 | Lin | |
| 2003/0190884 | A1 * | 10/2003 | Lee | H05K 7/20209 454/184 |
| 2005/0143001 | A1 * | 6/2005 | Merlet | H05K 7/20172 454/184 |
| 2006/0133920 | A1 * | 6/2006 | Chen | F04D 25/0613 415/76 |
| 2010/0040457 | A1 | 2/2010 | Tsen | |
| 2018/0163960 | A1 * | 6/2018 | Lin | F04D 25/0613 |
| 2019/0029143 | A1 * | 1/2019 | Xie | F21V 33/0096 |

FOREIGN PATENT DOCUMENTS

| | | | | |
|---|---|---|---|---|
| CN | 205263735 U | | 5/2016 | |
| CN | 206092473 U | | 4/2017 | |
| CN | 206206210 U | | 5/2017 | |
| CN | 206368839 | * | 8/2018 | F04D 25/08 |
| TW | M349665 U | | 1/2009 | |
| TW | M386750 U | | 8/2010 | |

* cited by examiner

*Primary Examiner* — Matthew J. Peerce
*Assistant Examiner* — Fatima N Farokhrooz
(74) *Attorney, Agent, or Firm* — Maschoff Brennan

(57) ABSTRACT

An illumination fan includes a first frame, a second frame, a fan blade, a light guide and a light source. The first frame includes an accommodation space. The second frame is assembled with the first frame, and an inner surface of the second frame is substantially flat. The fan blade is rotatably disposed in the accommodation space. The light source is disposed on either the first frame or the second frame. The light guide is disposed on the first frame and surrounds the fan blade.

10 Claims, 12 Drawing Sheets

ILLUMINATION FAN

TECHNICAL FIELD

The present disclosure relates to a fan in an electronic device, more particularly to an illumination fan.

BACKGROUND

As an electronic device is used universally, it not only has to be practical but also to be attractive in its appearance. Nowadays, a chassis of a personal computer has evolved from a gray ugly box twenty years ago to a multi media consumer electronic product in variety of shapes. In order to enhance the appearance of the personal computer, one way is to make the cooling fan emit light.

A conventional illumination fan generally includes a fan housing, a fan blade, multiple LEDs and a light guide. The fan blade is rotatably disposed in the inside of the frame, and both the LEDs and the light guide are disposed around fan blade. The light emitted from the LEDs travels to the outside of the illumination fan through the light guide.

In the conventional illumination fan, for the convenience of assembly, the fan housing includes an upper frame and a lower frame which are assembled together, and the light guide is accommodated in a space formed by the lateral walls of the upper frame and the lower frame. Due to a manufacturing tolerance of the frame, the space is probably insufficient to accommodate the light guide. One solution is to form a relatively large space to ensure the assembling yield rate, but rendering a shortcoming that the size of the illumination fan is extremely large.

SUMMARY

According to one aspect of the present disclosure, an illumination fan includes a first frame, a second frame, a fan blade, a light guide and a light source. The first frame includes an accommodation space. The second frame is assembled with the first frame, and an inner surface of the second frame is substantially flat. The fan blade is rotatably disposed in the accommodation space. The light source is disposed on either the first frame or the second frame. The light guide is disposed on the first frame and surrounds the fan blade.

According to another aspect of the present disclosure, an illumination fan includes a first frame, a second frame, a fan blade, a light guide and a light source. The first frame includes an accommodation space. The second frame is assembled with the first frame. The fan blade is rotatably disposed in the accommodation space. The light source is disposed on either the first frame or the second frame. The light guide is disposed on the first frame and surrounds the fan blade. Any portion of the second frame is not located between the fan blade and the light guide in a radial direction of the illumination fan.

According to still another aspect of the present disclosure, an illumination fan includes a first frame, a second frame, a fan blade, a light guide and a light source. The first frame includes an accommodation space. The second frame is assembled with the first frame, and there is no raised area on an inner surface of the second frame. The fan blade is rotatably disposed in the accommodation space. The light source is disposed on either the first frame or the second frame. The light guide is disposed on the first frame and surrounds the fan blade.

According to yet one aspect of the present disclosure, an illumination fan includes a first frame, a second frame, a fan blade, a light guide and a light source. The first frame includes a first lateral wall and a second lateral wall connected to each other. The first lateral wall and the second lateral wall jointly define an accommodation groove, and the first frame includes an accommodation space. The second frame is assembled with the first frame. The fan blade is rotatably disposed in the accommodation space, and the first lateral wall is closer to the fan blade than the second lateral wall. The light source is disposed on either the first frame or the second frame. The light guide is disposed in the accommodation groove and surrounds the fan blade.

According to yet still one aspect of the present disclosure, an illumination fan includes a first frame, a second frame, a fan blade, a light guide and a light source. The first frame includes a lateral wall and an accommodation space. The second frame is assembled with the first frame. The fan blade is rotatably disposed in the accommodation space, and the lateral wall of the first frame is located on a side of the fan blade. The light source is disposed on either the first frame or the second frame. The light guide is disposed on the first frame and surrounds the fan blade. The light guide includes at least one light guide portion and at least one protrusion located on a lateral side of the light guide portion facing toward the fan blade. The protrusion is fitted into at least one opening of the lateral wall.

BRIEF DESCRIPTION OF THE DRAWINGS

The present disclosure will become more fully understood from the detailed description given hereinbelow and the accompanying drawings which are given by way of illustration only and thus are not intending to limit the present disclosure and wherein.

DETAILED DESCRIPTION

In the following detailed description, for purposes of explanation, numerous specific details are set forth in order to provide a thorough understanding of the disclosed embodiments. It will be apparent, however, that one or more embodiments may be practiced without these specific details. In other instances, well-known structures and devices are schematically shown in order to simplify the drawings.

Figure 1A:
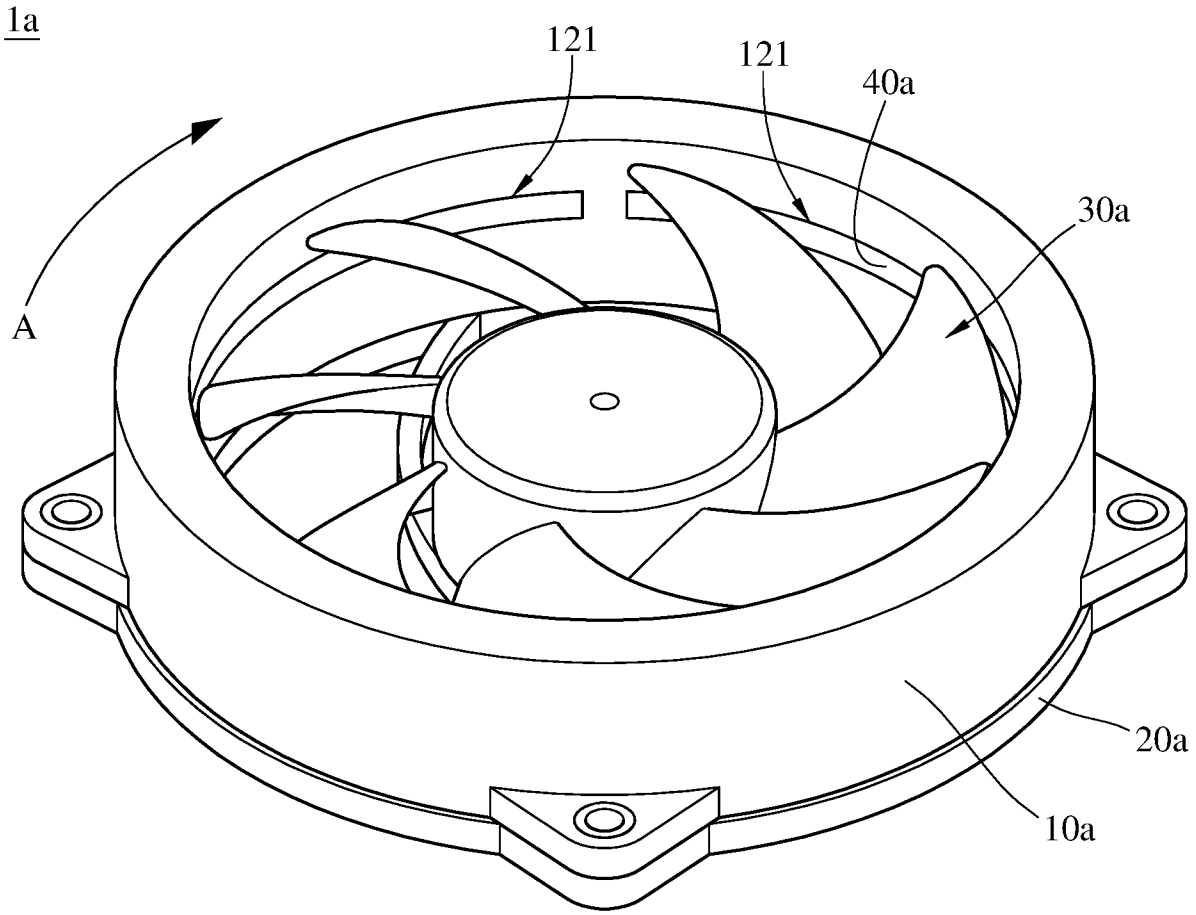
FIG. 1A is a perspective view of an illumination fan according to a first embodiment of the present disclosure.
Figure 1B:
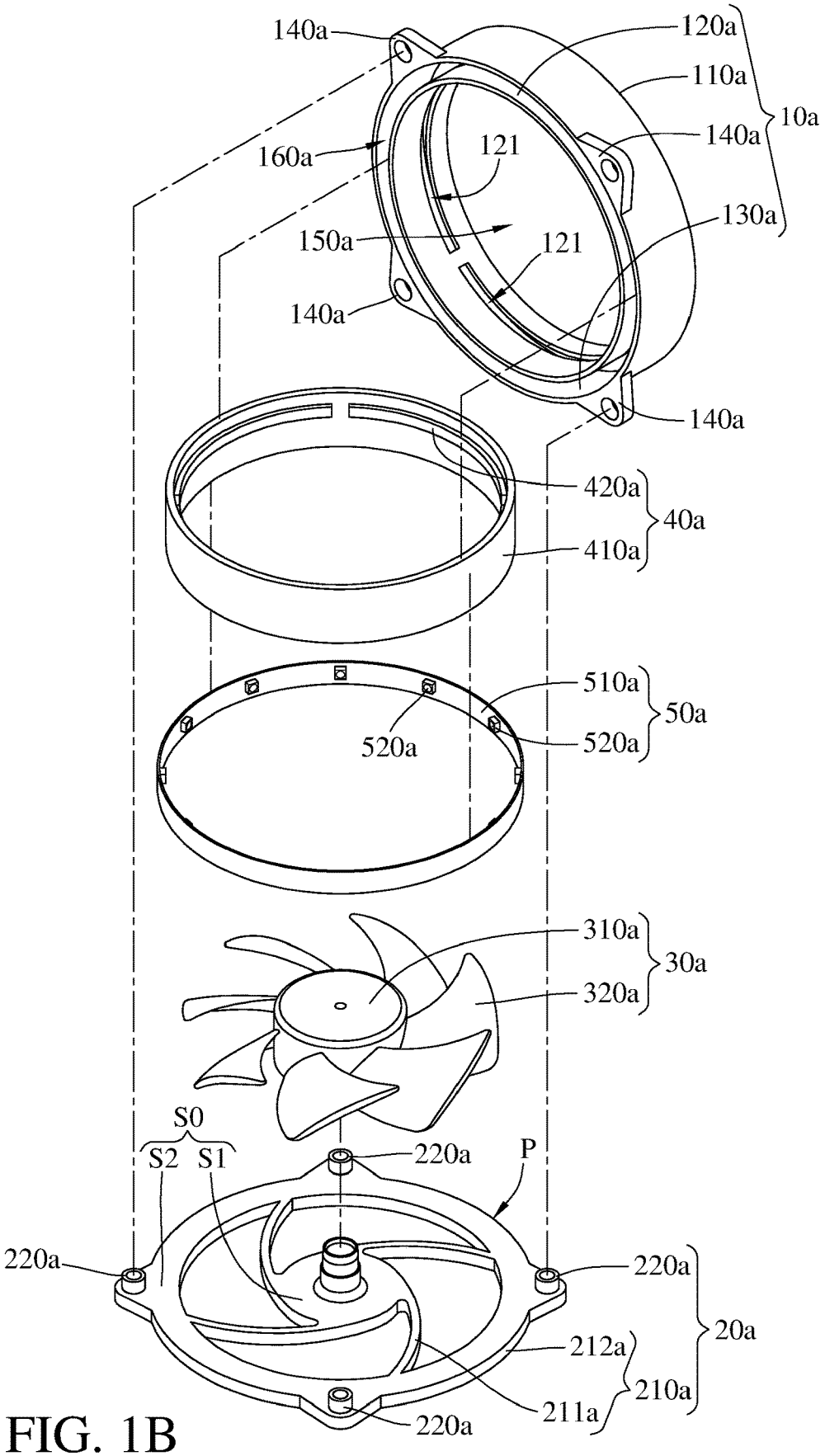
FIG. 1B is an exploded view of the illumination fan in FIG. 1A.
Figure 1C:
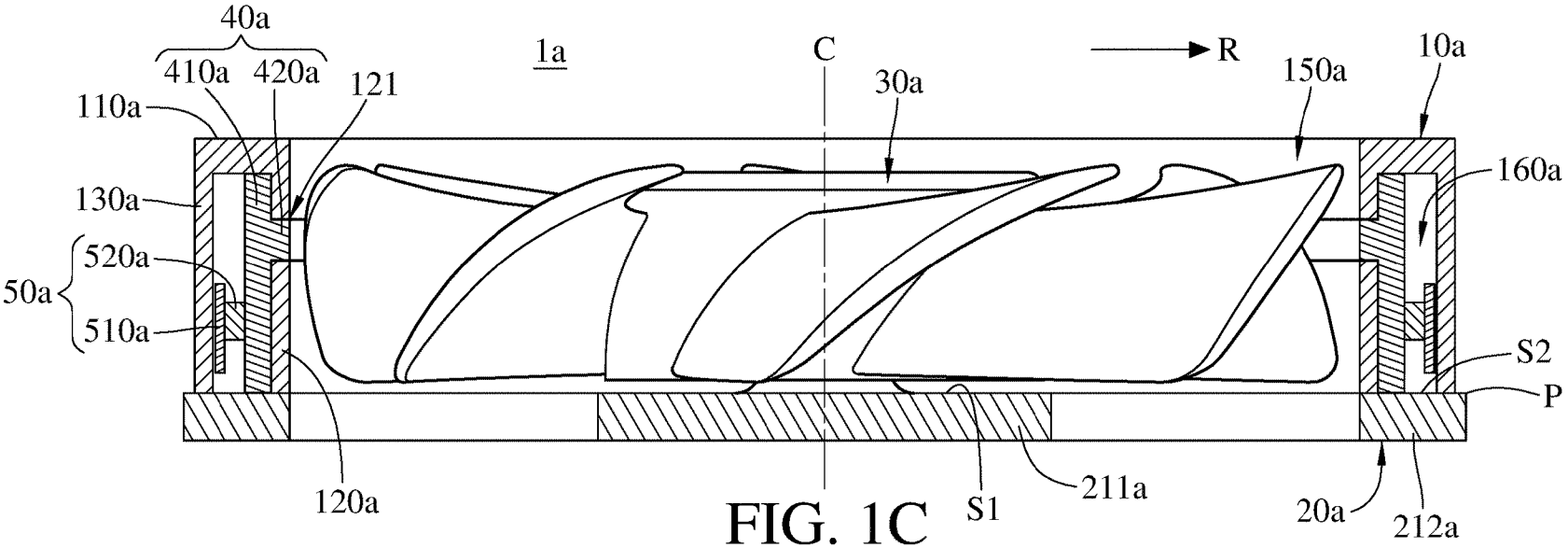
FIG. 1C is a cross-sectional view of the illumination fan in FIG. 1A.

Please refer to FIG. 1A to FIG. 1C. FIG. 1A is a perspective view of an illumination fan according to a first embodiment of the present disclosure. FIG. 1B is an exploded view of the illumination fan in FIG. 1A. FIG. 1C is a cross-sectional view of the illumination fan in FIG. 1A. In this embodiment, an illumination fan 1 is disclosed, and the illumination fan 1*a* includes a first frame 10*a*, a second frame 20*a*, a fan blade 30*a*, a light guide 40*a* and a light source 50*a*. The illumination fan 1*a* is, for example but not limited to, a cooling fan accommodated in a chassis of a personal computer.

The first frame 10*a* is an upper frame of the illumination fan 1*a* which is made of opaque material, and the first frame 10*a* includes an upper cover 110*a*, a first lateral wall 120*a*, a second lateral wall 130*a* and a plurality of assembling structures 140*a*. The first lateral wall 120*a* and the second lateral wall 130*a* are connected to the upper cover 110*a*. The upper cover 110*a* and the first lateral wall 120*a* jointly define an accommodation space 150*a*. The first lateral wall 120*a* and the second lateral wall 130*a* jointly define an accommodation groove 160*a*. The assembling structures 140*a* are disposed on the second lateral wall 130*a*. The position of the assembling structure 140*a*, the shape of the assembling structure 140*a* and the number of the assembling structure 140*a* are not limited by the above. In this embodiment, each of the assembling structures 140*a* is a flange including a through hole. The first lateral wall 120*a* of the first frame 10*a* includes a plurality of openings 121 arranged in a circumferential direction A of the illumination fan 1*a* and surrounding the accommodation space 150*a*.

The second frame 20*a* is a lower frame of the illumination fan 1*a* which is made of opaque material, and the second frame 20*a* includes a frame body 210*a* and a plurality of assembling structures 220*a* located on an inner surface S0 of the frame body 210*a*. In detail, the frame body 210*a* includes a rib portion 211*a* and an annular portion 212*a* connected to each other. The assembling structures 220*a* are disposed on the annular portion 212*a* and located nearby a periphery P of the frame body 210*a*. The first frame 10*a* is assembled with the second frame 20*a* by the assembling structures 220*a*. The position of the assembling structure 220*a*, the shape of the assembling structure 220*a* and the number of the assembling structure 220*a* are not limited by the above. In this embodiment, each of the assembling structures 220*a* is a pin corresponding to the assembling structure 140*a*.

In this embodiment, the inner surface S0 of the frame body 210*a* is interpreted as a surface of the frame body 210*a*, which faces toward the first frame 10*a*, extends from a center C of the frame body 210*a* to the periphery P of the frame body 210*a*. That is, an inner surface S1 of the rib portion 211*a* and an inner surface S2 of the annular portion 212*a* jointly define the inner surface S0. The inner surface S1 is one section of the inner surface S0, and the inner surface S2 is the other section of the inner surface S0. The inner surface S0 of the frame body 210*a* is substantially flat; that is, both of the inner surfaces S1 and S2 are not sloping or curving.

The fan blade 30*a* is disposed in the accommodation space 150*a* and includes a rotor 310*a* and a plurality of vanes 320*a*. The vanes 320*a* are disposed on the rotor 310*a*, and the rotor 310*a* of the fan blade 30*a* is disposed on the rib portion 211*a* of the second frame 20*a*. The inner surface S0 of the frame body 210*a* faces toward the fan blade 30*a*. In this embodiment, the inner surface S1 of the rib portion 211*a* faces toward the fan blade 30*a*. In some embodiments, on the condition that the vanes 320*a* or the annular portion 212*a* has a large radial size, a part of the inner surface S2 of the annular portion 212*a* faces toward the fan blade 30*a*.

The light guide 40*a* is disposed on the first frame 10*a* and surrounds the fan blade 30*a*. In detail, the light guide 40*a* includes a light guide portion 410*a* and a plurality of protrusions 420*a*. The protrusions 420*a* are disposed on a lateral side of the light guide portion 410*a* facing toward the fan blade 30*a*, and each protrusion 420*a* is fitted into one of the openings 121 of the first lateral wall 120*a*. The first lateral wall 120*a* of the first frame 10*a* is located between the fan blade 30*a* and the light guide portion 410*a*. As shown in FIG. 1C, any portion of the second frame 20*a* is not located between the fan blade 30*a* and the light guide 40*a* in a radial direction R of the illumination fan 1*a*.

The light source 50*a* is disposed on the first frame 10*a*. In detail, the light source 50*a* is disposed in the accommodation groove 160*a* and located between the light guide 40*a* and the second lateral wall 130*a* of the first frame 10*a*. The light source 50*a* includes an annular circuit board 510*a* and a plurality of light emitting diodes (LEDs) 520*a*. The annular circuit board 510*a* surrounds the fan blade 30*a*, and the LEDs 520*a* are located on a side of the annular circuit board 510*a* close to the fan blade 30*a*.

When the LEDs 520*a* of the light source 50*a* illuminate, light rays generated by the LEDs 520*a* travel into the light guide 40*a* so as to make the light guide 40*a* emit light. In detail, light rays generated by the LEDs 520*a* travel into the light guide portion 410*a* of the light guide 40*a* and then exit from the protrusions 420*a* in the openings 121, thereby forming ring light at a proximity to the fan blade 30*a*.

The light guide 40*a* may include brushed surface so as to be favorable for even light intensity and soft emitted light. Furthermore, it is worth noting that the light source 50*a* includes the LEDs 520*a* is not limited by the above. In some other embodiments, the light source includes different illuminating component on the annular circuit board, such as florescent lights and organic LEDs.

The light guide 40*a* is made of transparent material having a larger transparency than the first frame 10*a* and the second frame 20*a*. The transparent material, for example, is poly(methyl methacrylate) (PMMA), cyclo olefin polymer (COP) or polycarbonate (PC), and the light guide 40*a* can be manufactured by injection molding. A total reflection of light in the light guide 40*a* makes the light rays generated by the light source 50*a* travel to a position relatively away from the light source 50*a*.

The fan blade 30*a* is also made of transparent material, such that the fan blade 30*a* can emit light when the light rays travel into the fan blade 30*a* from the light guide 40*a*, but the present disclosure is not limited thereto. The fan blade is made of opaque material in some other embodiments.

Figure 2:
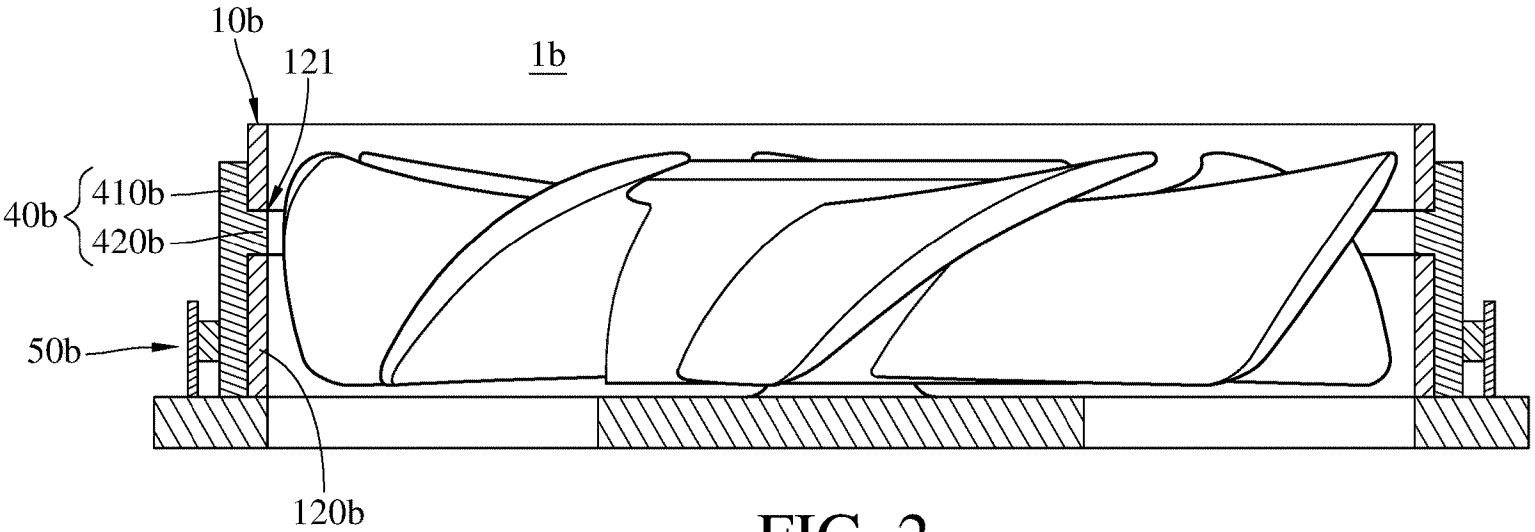
FIG. 2 is a cross-sectional view of an illumination fan according to a second embodiment of the present disclosure.

The first frame in the first embodiment includes the upper cover and the second lateral wall, but the present disclosure is not limited thereto. FIG. 2 is a cross-sectional view of an illumination fan according to a second embodiment of the present disclosure. Since the second embodiment is similar to the first embodiment, only the differences will be illustrated hereafter.

In this embodiment, an illumination fan 1*b* includes a first frame 10*b* without an upper cover and a second lateral wall. A light guide 40*b* is fastened to an opening 121 of a first lateral wall 120*b* of the first frame 10*b* so as to be disposed on the first frame 10*b*. An assembling structure (not shown in the drawings) of the first frame 10*b* is disposed on the first lateral wall 120*b*. A light source 50*b* is disposed on a light guide portion 410*b* of the light guide 40*b*.

Since the light guide portion 410*b* is not blocked by the first frame 10*b*, light rays generated by the light source 50*b* travel into the light guide 40*b* so as to form a ring light at the outside of the illumination fan 1*b*. Therefore, ring light is formed at both the inside and the outside of the illumination fan 1*b*, and thus the illumination fan 1*b*, which is different in appearance from the illumination fan 1*a*, is obtained.

Figure 3A:
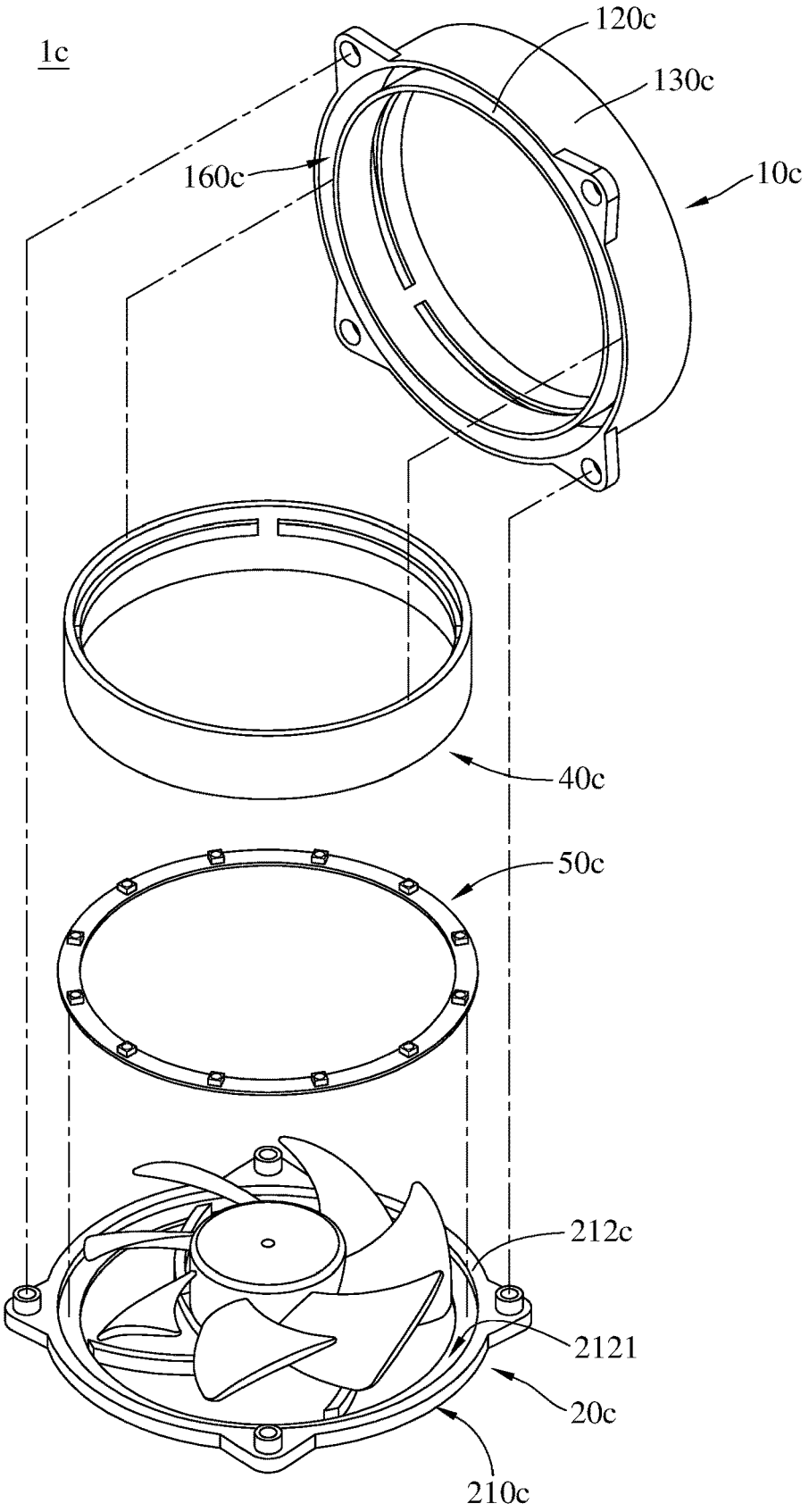
FIG. 3A is an exploded view of an illumination fan according to a third embodiment of the present disclosure.
Figure 3B:
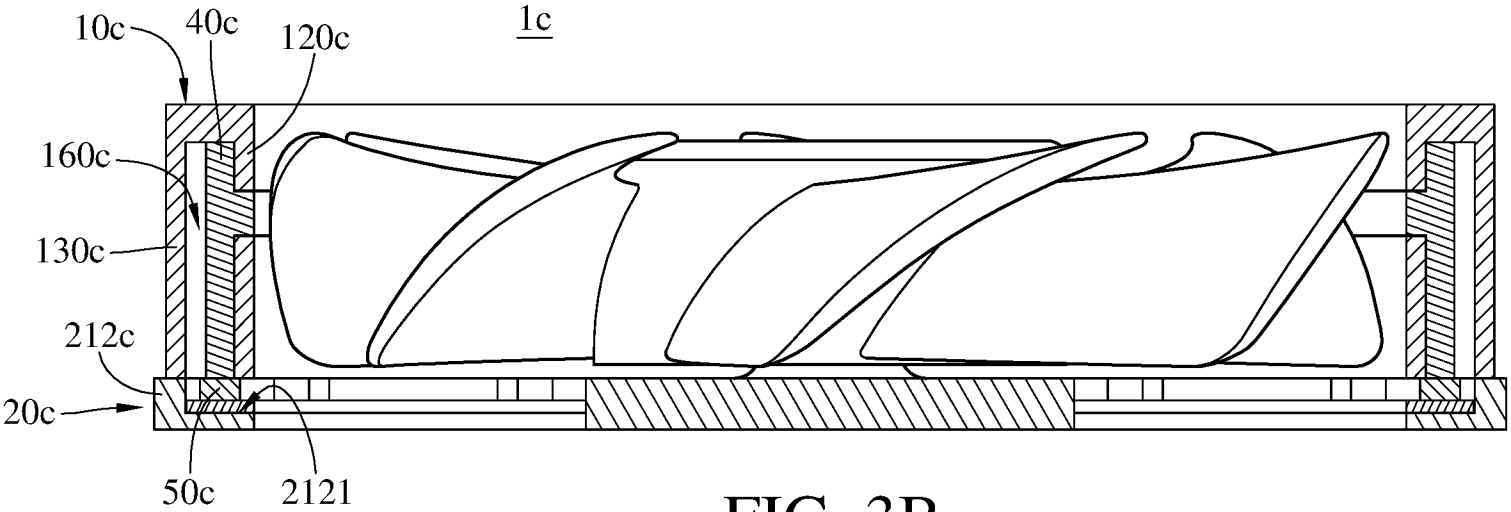
FIG. 3B is a cross-sectional view of the illumination fan in FIG. 3A.

The inner surface of the second frame in the first embodiment is sub substantially flat, but the present disclosure is not limited thereto. FIG. 3A is an exploded view of an illumination fan according to a third embodiment of the present disclosure. FIG. 3B is a cross-sectional view of the illumination fan in FIG. 3A. Since the third embodiment is similar to the first embodiment, only the differences will be illustrated hereafter.

In this embodiment, an illumination fan 1*c* includes a second frame 20*c* including a frame body 210*c*, and the frame body 210*c* includes an annular portion 212*c*. The annular portion 212*c* includes a recess 2121, and a light source 50*c* is disposed in the recess 2121 instead of an accommodation groove 160*c* of a first frame 10*c*. Therefore, a proper space of the accommodation groove 160*c* can meet the size of a light guide 40*c*. Specifically, the gap between a first lateral wall 120*c* and a second lateral wall 130*c* of the first frame 10*c* for accommodating the light guide 40*c* is smaller than the gap between the first lateral wall 120*a* and the second lateral wall 130*a* in FIG. 1, such that a radial size of the illumination fan 1*c* is reduced so as to achieve compactness.

Figure 4:
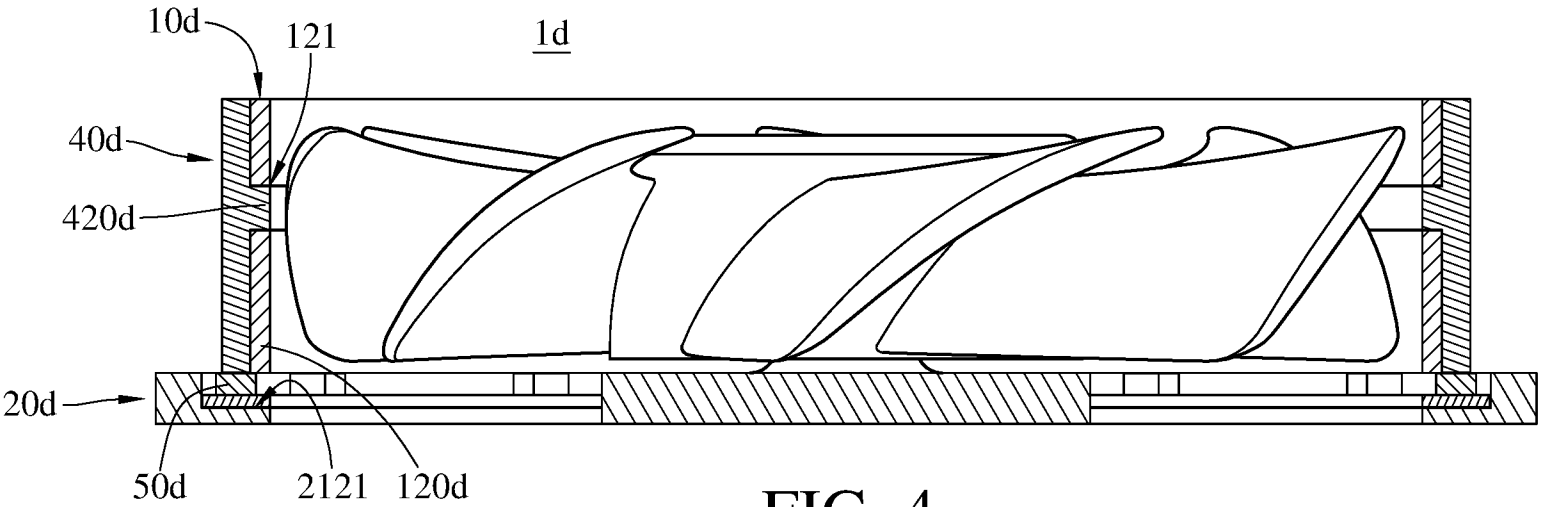
FIG. 4 is a cross-sectional view of an illumination fan according to a fourth embodiment of the present disclosure.

FIG. 4 is a cross-sectional view of an illumination fan according to a fourth embodiment of the present disclosure. Since the fourth embodiment is similar to the third embodiment, only the differences will be illustrated hereafter.

In this embodiment, an illumination fan 1*d* includes a first frame 10*d* without an upper cover and a second lateral wall. A light guide 40*d* is disposed on the first frame 10*d* by fitting a protrusion 420*d* into an opening 121 of a first lateral wall 120*d* of the first frame 10*d* b. A light source 50*d* is disposed in a recess 2121 of a second frame 20*d*.

Since a light guide portion 410*d* of the light guide 40*d* is not blocked by the first frame 10*d*, light rays generated by the light source 50*d* travel into the light guide 40*d* so as to form a ring light at the outside of the illumination fan 1*d*. The recess 2121 for accommodating the light source 50*d* is favorable for the light guide portion 410*d* to cover the light source 50*d* so as to obtain the illumination fan 1*d* having better appearance.

The illumination fans in the first through the fourth embodiments each include the second frame, and there is no raised area on the inner surface of the frame body of the second frame. In detail, in the first and the second embodiments, the inner surface of the frame body is substantially flat; and in the third and the fourth embodiments, the inner surface of the frame body includes a recess.

Figure 5A:
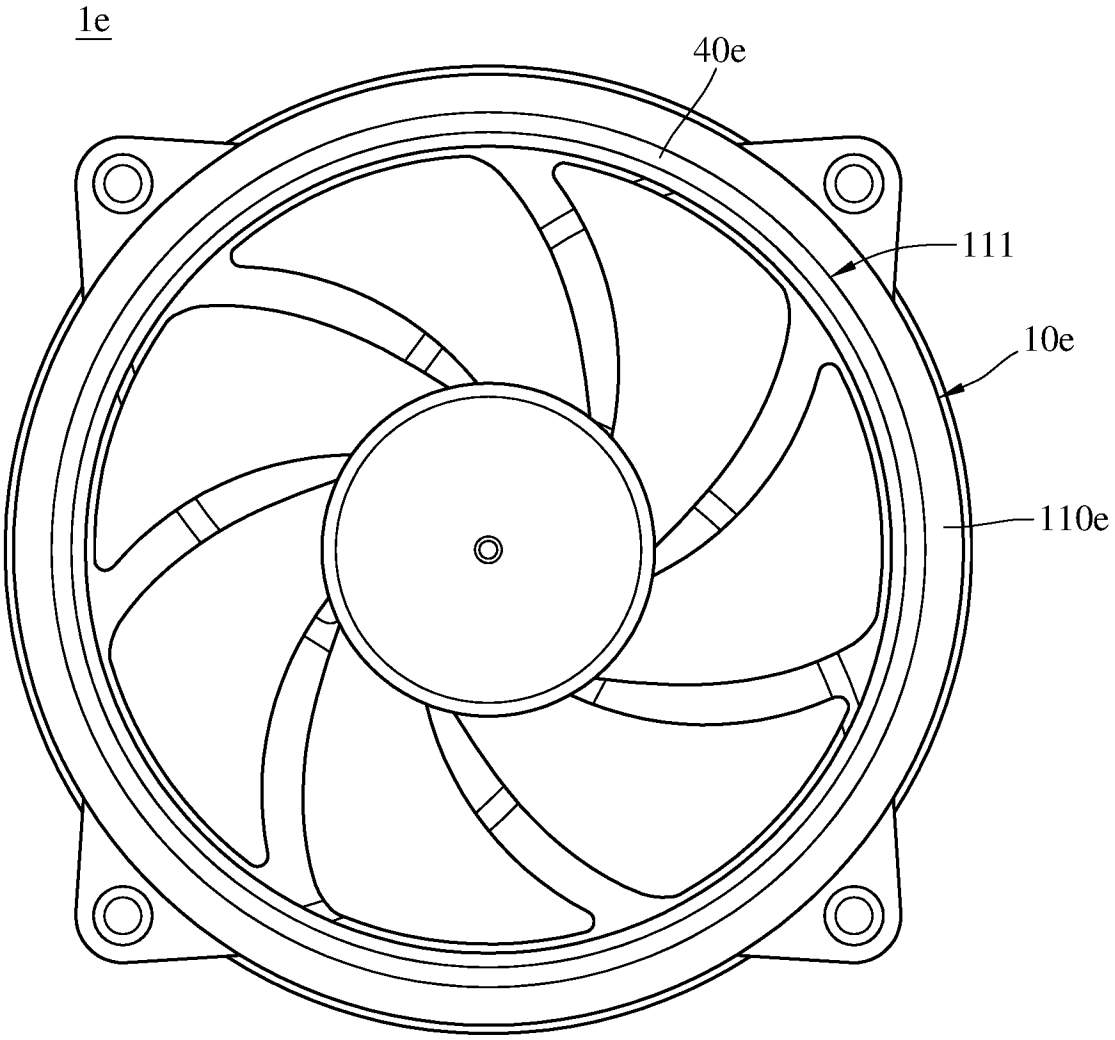
FIG. 5A is a top view of an illumination fan according to a fifth embodiment of the present disclosure.
Figure 5B:
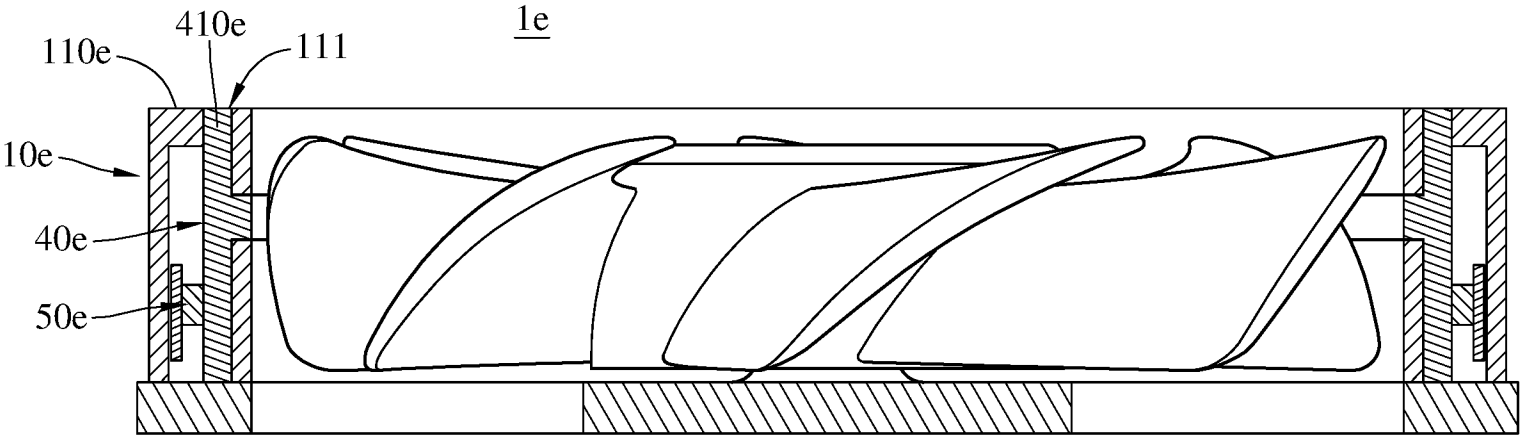
FIG. 5B is a cross-sectional view of the illumination fan in FIG. 5A.

A ring light is formed at the proximity to the fan blade in the first embodiment, but the present disclosure is not limited thereto. FIG. 5A is a top view of an illumination fan according to a fifth embodiment of the present disclosure. FIG. 5B is a cross-sectional view of the illumination fan in FIG. 5A. Since the fifth embodiment is similar to the first embodiment, only the differences will be illustrated hereafter.

In this embodiment, an illumination fan 1*e* includes a first frame 10*e* including an upper cover 110*e*, and a part of a light guide portion 410*e* of a light guide 40*e* is disposed in an annular opening 111 of the first frame 10*e*. Light rays generated by the light source 50*e* travel into the light guide 40*e* and then exit from the part of the light guide portion 410*e* in the annular opening 111, thereby forming a ring light at the top of the first frame 10*e*. The light guide 40*e* is favorable for forming ring lights at both the top of the first frame 10*e* and the lateral side of the first frame 10*e* so as to obtain the illumination fan 1*e* with different appearance from the illumination fans 1*a* and 1*b*.

Figure 6:
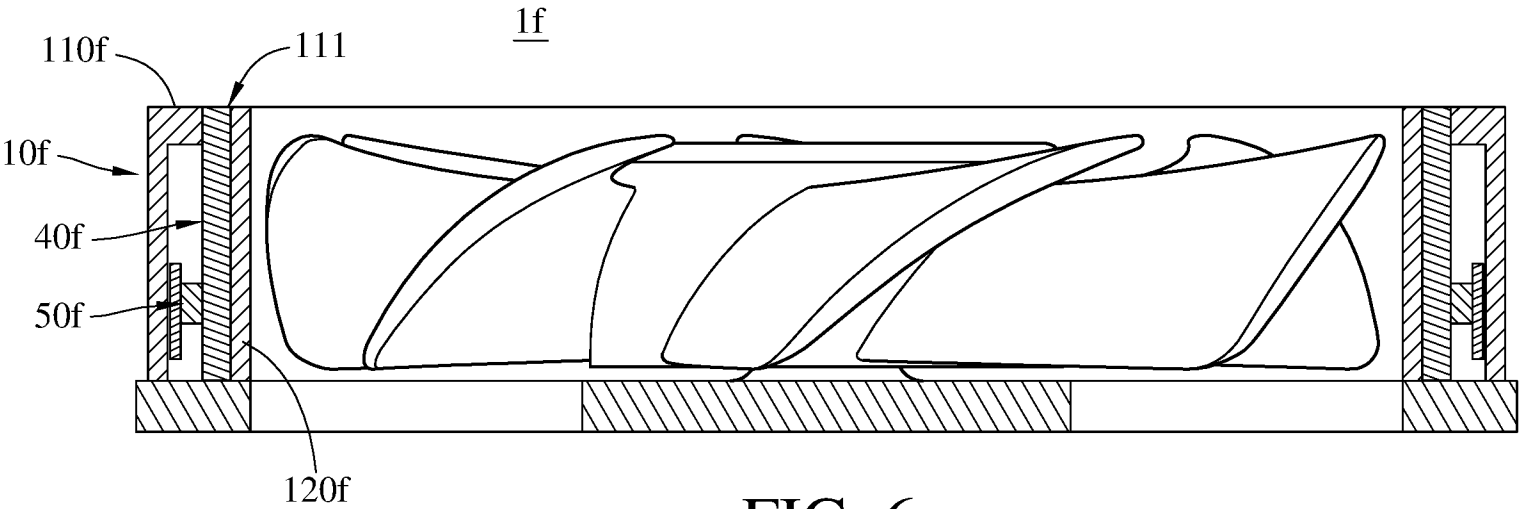
FIG. 6 is a cross-sectional view of an illumination fan according to a sixth embodiment of the present disclosure.

FIG. 6 is a cross-sectional view of an illumination fan according to a sixth embodiment of the present disclosure. Since the sixth embodiment is similar to the fifth embodiment, only the differences will be illustrated hereafter.

In this embodiment, an illumination fan 1*f* includes a first frame 10*f* including an upper cover 110*f* and a light guide 40*f* without protrusion. A part of a light guide portion 410*f* of a light guide 40*f* is disposed in an annular opening 111 of the first frame 10*f*. The first frame 10*f* further includes a first lateral wall 120*f* without opening. Light rays generated by a light source 50*f* travel into the light guide 40*f* and then exit from the part of the light guide portion 410*f* in the annular opening 111, thereby forming a ring light at the top of the first frame 10*f*.

Figure 7:
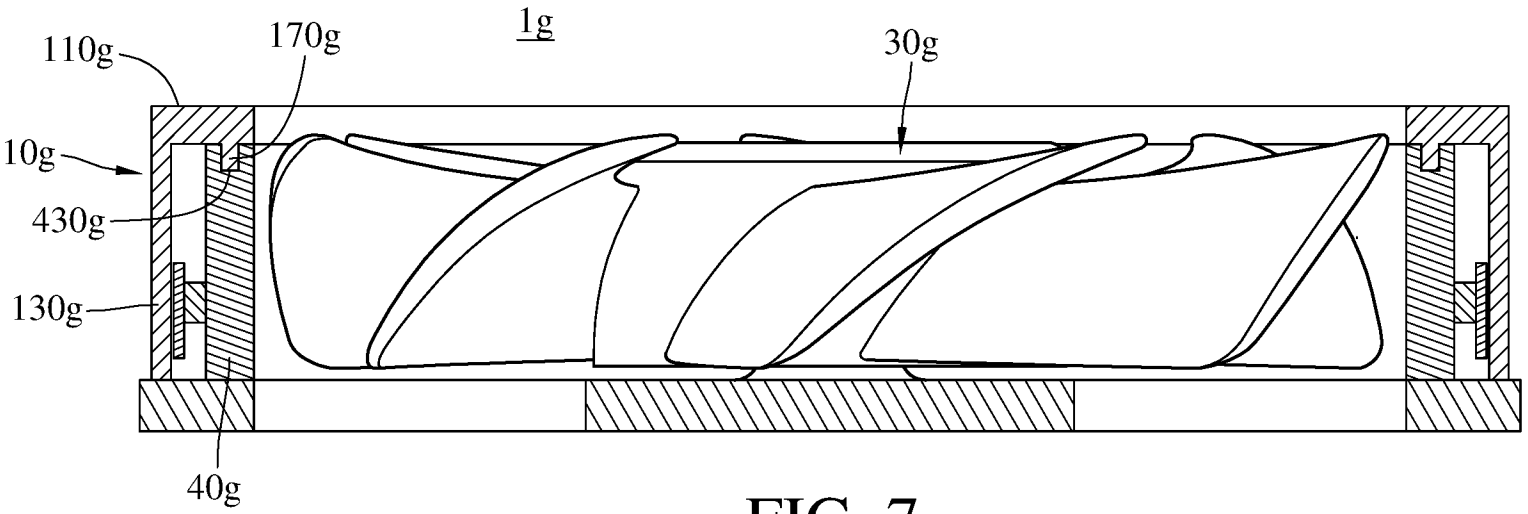
FIG. 7 is a cross-sectional view of an illumination fan according to a seventh embodiment of the present disclosure.

FIG. 7 is a cross-sectional view of an illumination fan according to a seventh embodiment of the present disclosure. Since the seventh embodiment is similar to the first embodiment, only the differences will be illustrated hereafter.

In this embodiment, an illumination fan 1*g* includes a first frame 10*g* without a first lateral wall. The first frame 10*g* includes an upper cover 110*g*, a second lateral wall 130*g* and an annular flange 170*g* located on the upper cover 110*g*. A light guide 40*g*, without protrusion, includes an annular slot 430*g* located on a side of the light guide 40*g* close to the upper cover 110*g*. The light guide 40*g* is disposed on the first frame 10*g* by fastening the annular flange 170*g* into the annular slot 430*g*. Light rays travel into the light guide 40*g* and then exit from a side of the light guide 40*g* close to a fan blade 30*g*. Since the lateral side of the light guide 40*g* is not blocked by the first frame 10*g*, a larger ring light is formed at the proximity to the fan blade 30*g*.

Figure 8:
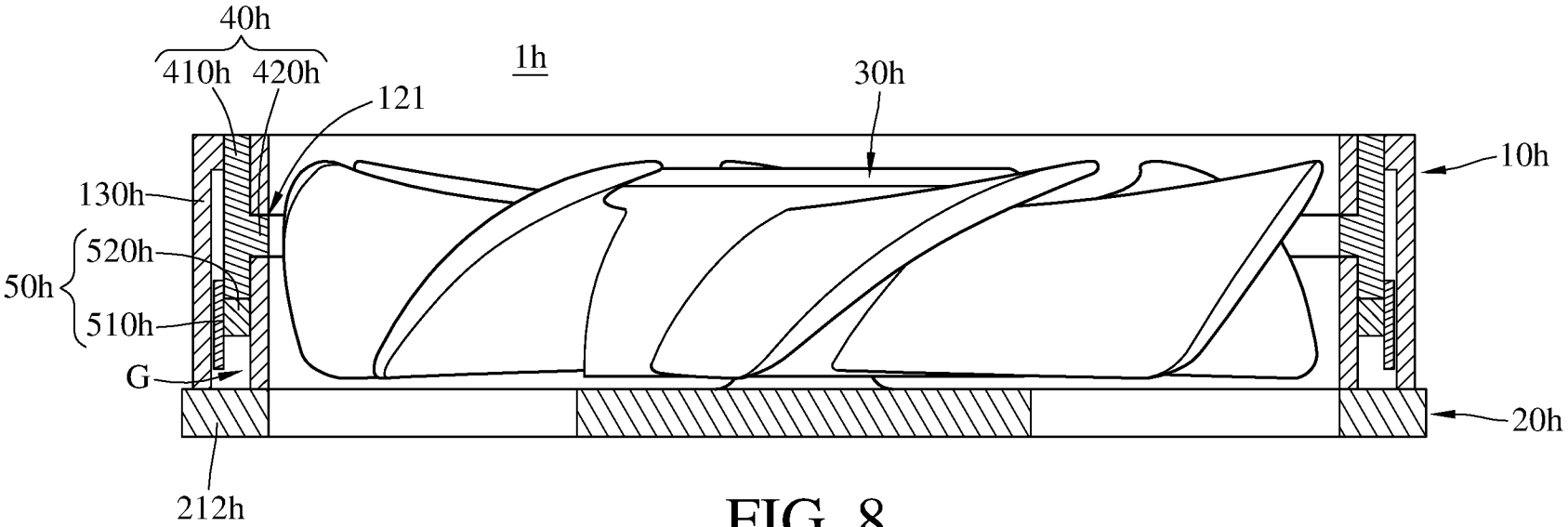
FIG. 8 is a cross-sectional view of an illumination fan according to an eighth embodiment of the present disclosure.

The light source in the first embodiment is disposed between the light guide and the second lateral wall of the first frame, but the present disclosure is not limited thereto. FIG. 8 is a cross-sectional view of an illumination fan according to an eighth embodiment of the present disclosure. Since the eighth embodiment is similar to the first embodiment, only the differences will be illustrated hereafter.

In this embodiment, an illumination fan 1*h* includes a light guide 40*h* and a second frame 20*h*. There is an air gap G between a light guide portion 410*h* of the light guide 40*h* and an annular portion 212*h* of the second frame 20*h*. A light source 50*h* is disposed in the air gap G so as to be located below the light guide portion 410*h*. In detail, a plurality of LEDs 520*h* of the light source 50*h* are disposed below the light guide portion 410*h*, and a part of an annular circuit board 510*h* is located between the light guide portion 410*h* and a second lateral wall 130*h*. The arrangement of the light source 50*h* is favorable for reducing the radial size of the illumination fan 1*h*. The light rays generated by the light source 50*h* travel into the light guide 40*h*, thereby forming a ring light at both the top of a first frame 10*h* and the proximity to a fan blade 30*h*.

Figure 9:
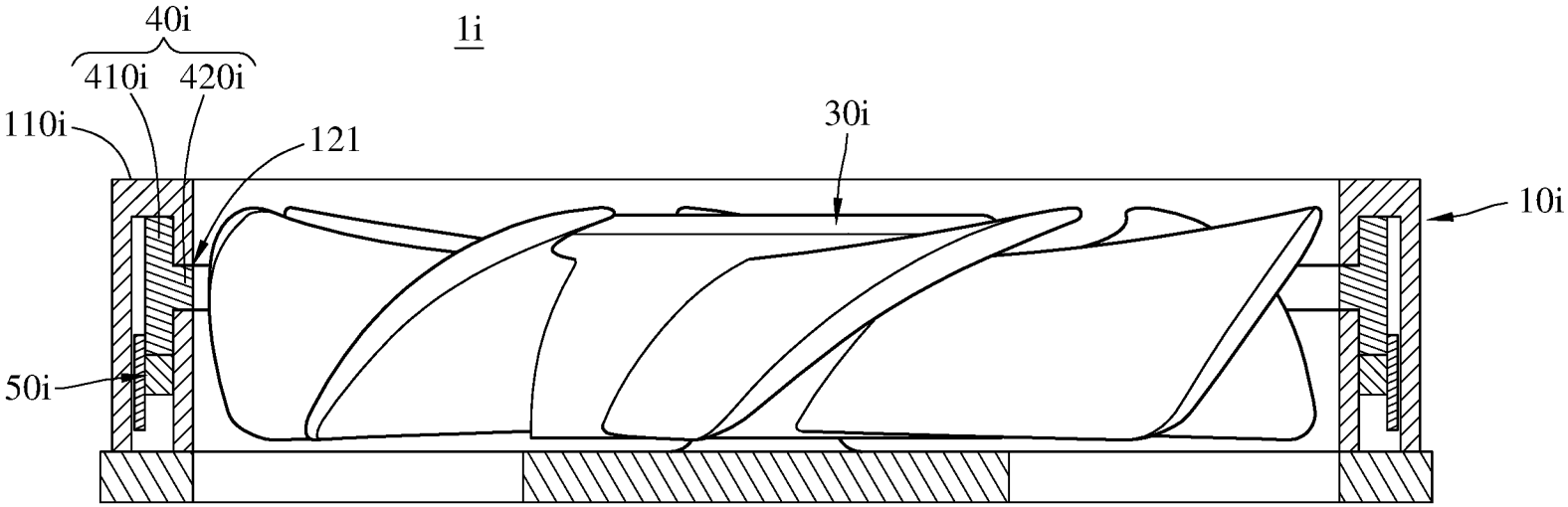
FIG. 9 is a cross-sectional view of an illumination fan according to a ninth embodiment of the present disclosure.

FIG. 9 is a cross-sectional view of an illumination fan according to a ninth embodiment of the present disclosure. Since the ninth embodiment is similar to the eighth embodiment, only the differences will be illustrated hereafter.

In this embodiment, an illumination fan 1*i* includes a first frame 10*i* including an upper cover 110*i* without annular opening. Therefore, light rays generated by a light source 50*i* travel into a light guide portion 410*i* of the light guide 40*i* and then only exit from a protrusion 420*i* of the light guide 40*i* in an opening 121 of the first frame 10*i*.

Figure 10A:
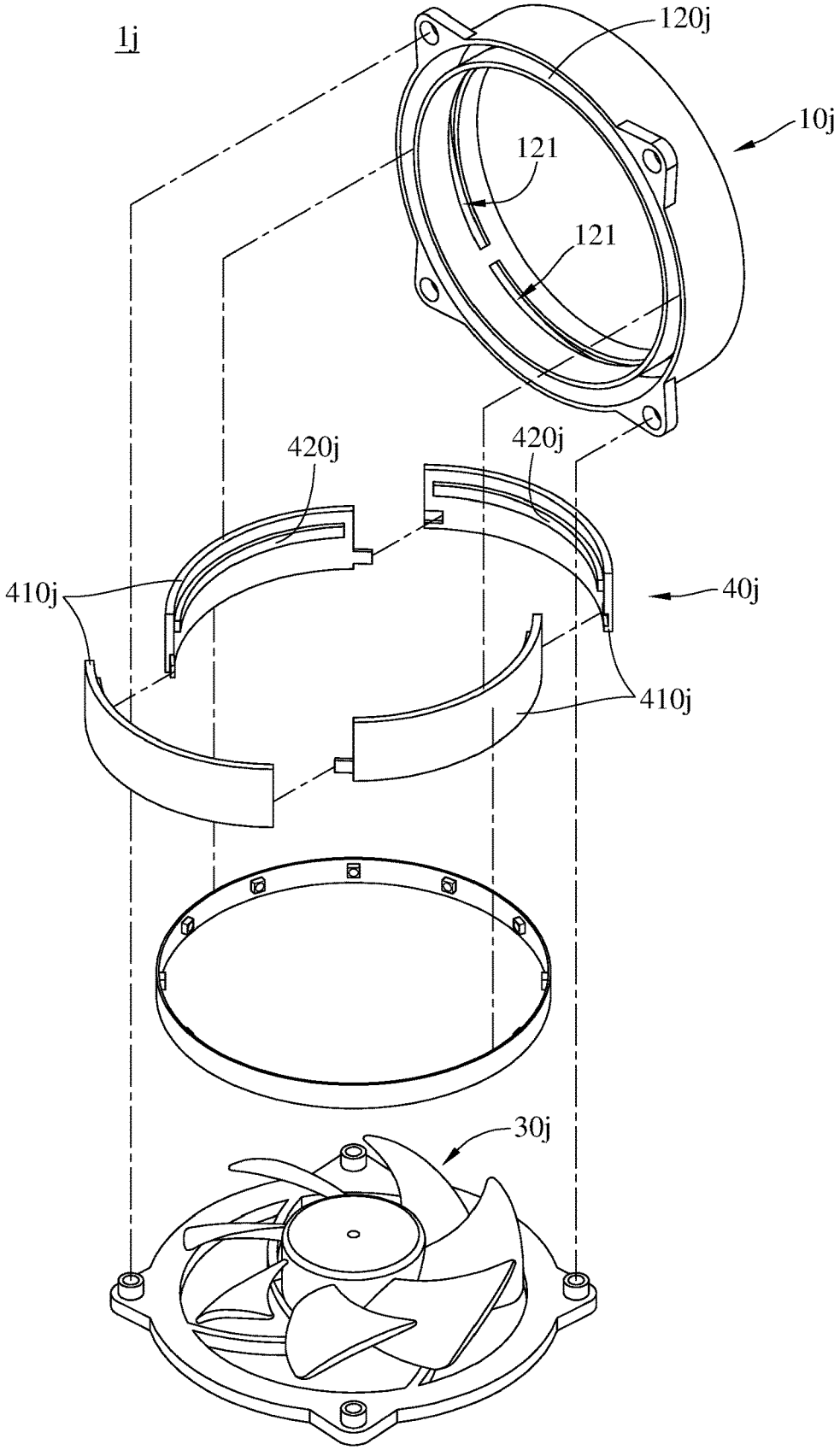
FIG. 10A is an exploded view of an illumination fan according to a tenth embodiment of the present disclosure.
Figure 10B:
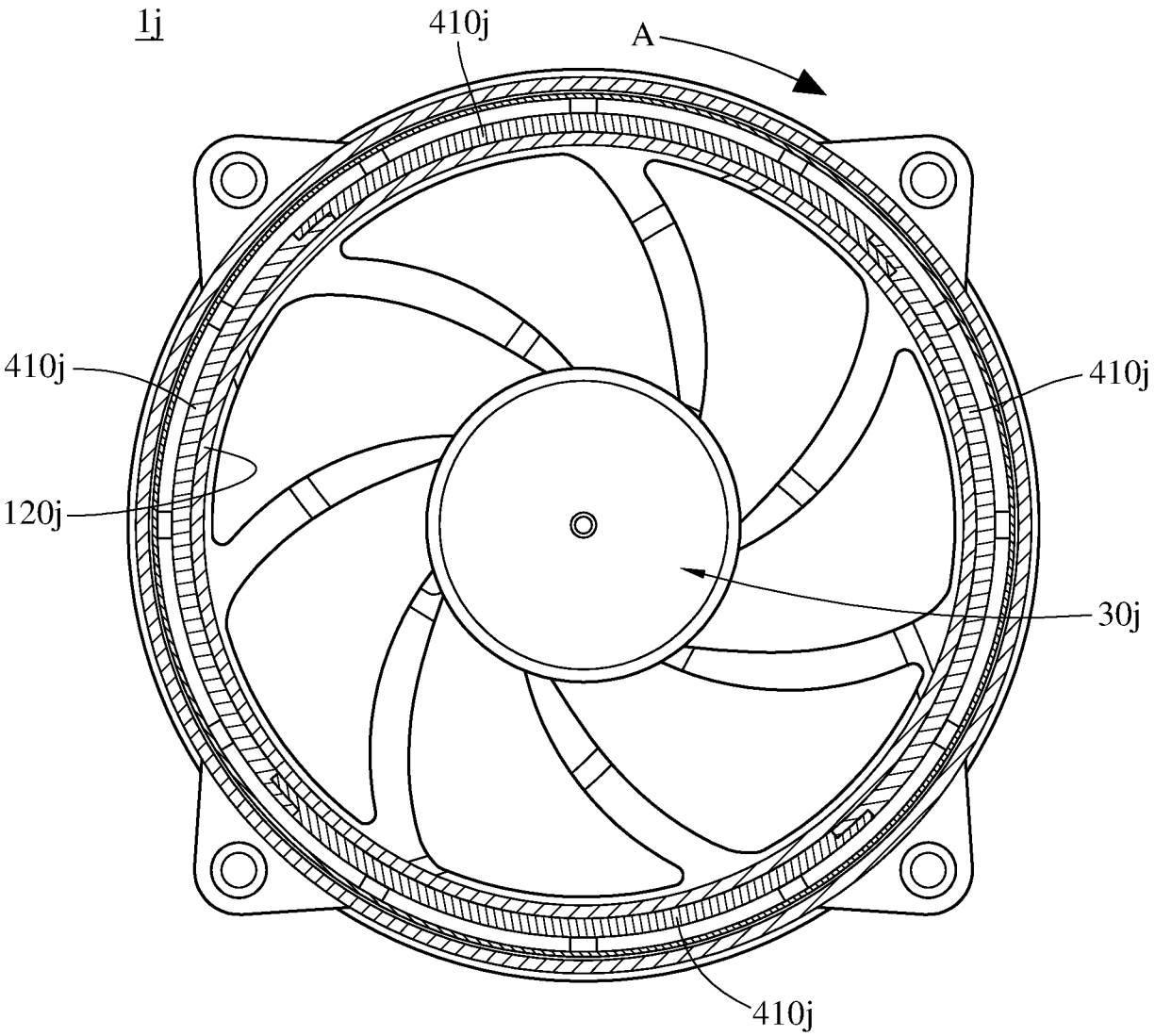
FIG. 10B is a cross-sectional view of the illumination fan in FIG. 10A.

The light guide in the first embodiment is a single piece, but the present disclosure is not limited thereto. FIG. 10A is an exploded view of an illumination fan according to a tenth embodiment of the present disclosure. FIG. 10B is a cross-sectional view of the illumination fan in FIG. 10A. Since the tenth embodiment is similar to the first embodiment, only the differences will be illustrated hereafter.

In this embodiment, an illumination fan 1*j* includes a light guide 40*j*, and the light guide 40*j* includes a plurality of light guide portions 410*j* which are assembled with each other. In detail, each of the light guide portions 410*j* is assembled with the other adjacent two of the light guide portions 410*j*, such that the light guide portions 410*j* surround a first lateral wall 120*j* of a first frame 10*j*. The light guide portions 410*j* are assembled with each other by, for example, a combination of latch and slot. In some other embodiments, the light guide portions 410*j* are assembled with each other by adhesion or screw.

The first lateral wall 120*j* of the first frame 10*j* includes a plurality of openings 121 arranged in the circumferential direction A of the illumination fan 1*h*. The light guide 40*j* further includes a plurality of protrusions 420*j* which are respectively located on lateral sides of the light guide portions 410*j* facing toward a fan blade 30*j*, and the protrusions 420*j* of the light guide 40*j* are respectively fitted into the openings 121. The light guide 40*j* formed by the assembly of the light guide portions 410*j* surrounds the first lateral wall 120*j* to allow ring light at the proximity to the fan blade 30*j*. The assembly of the light guide portions 410*j* is favorable for an easier installation of the light guide 40*j* to the first frame 10*j* so as to prevent overly dragging and pulling the light guide 40*j* during assembly.

Figure 11:
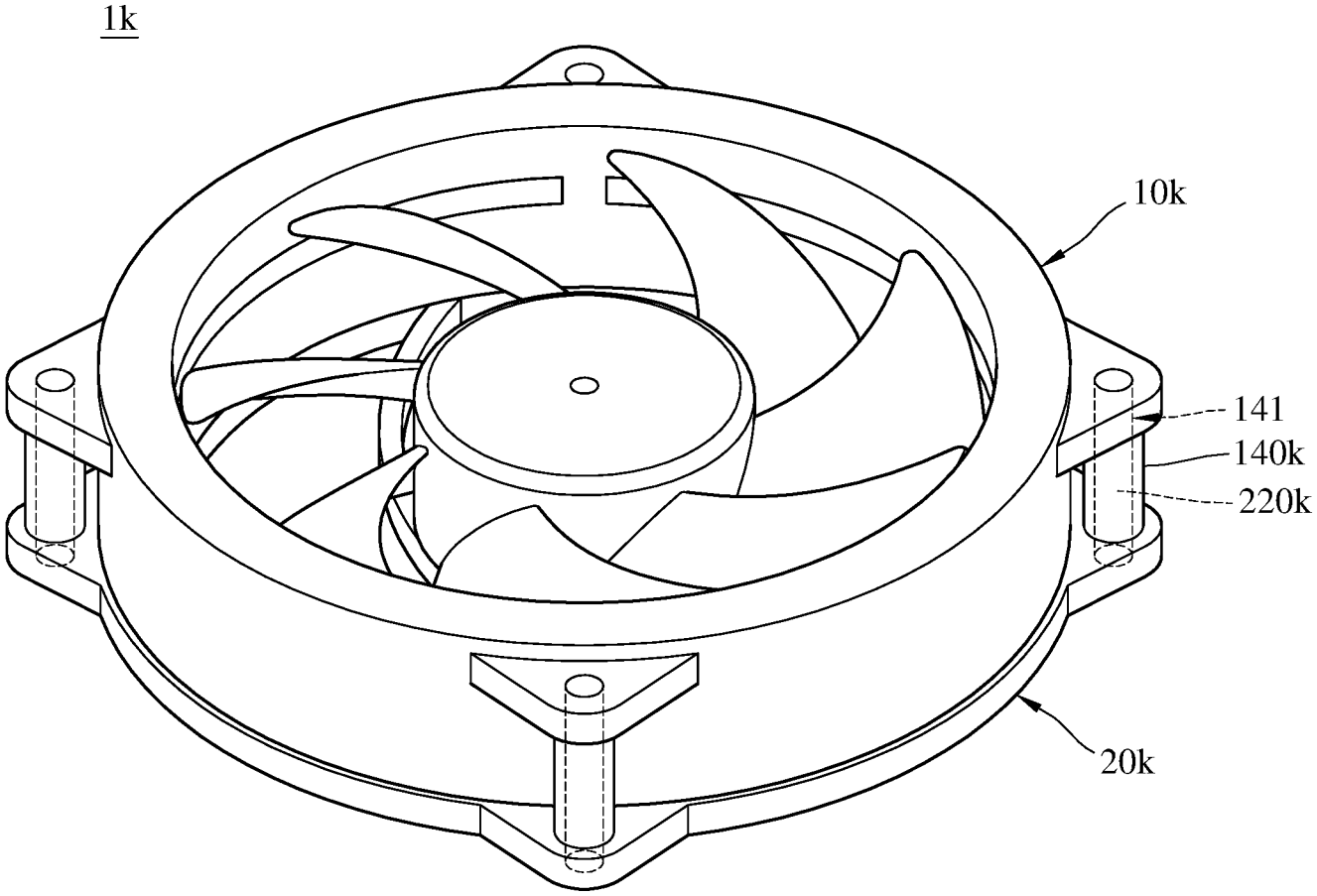
FIG. 11 is a perspective view of an illumination fan according to an eleventh embodiment of the present disclosure.

In the first embodiment, the assembling structure of the first frame is a flange having through hole, and the assembling structure of the second frame is a pin corresponding to the aforementioned through hole, but the present disclosure is not limited thereto. FIG. 11 is a perspective view of an illumination fan according to an eleventh embodiment of the present disclosure. Since the eleventh embodiment is similar to the first embodiment, only the differences will be illustrated hereafter.

In this embodiment, an illumination fan 1*k* includes a first frame 10*k* and a second frame 20*k*. Each of an assembling structure 140*k* of the first frame 10*k* and an assembling structure 220*k* of the second frame 20*k* is a pin. The diameter of the assembling structure 140*k* is larger than the diameter of the assembling structure 220*k*, and the assembling structure 140*k* includes a hole 141. The first frame 10*k* is assembled with the second frame 20*k* by inserting the assembling structure 220*k* into the hole 141 of the assembling structure 140*k*.

A difficult assembly of the components of a conventional illumination fan and an overly large size of the conventional illumination fan are some problems to be solved. Compared to the conventional illumination fan which includes the upper frame and the lower frame jointly forming a space for accommodating the light guide, the illumination fan of the present disclosure includes the upper frame (first frame) defining the accommodation groove for accommodating the light guide. Therefore, it is favorable for preventing insufficient amount of accommodation groove due to manufacturing tolerance.

According to one aspect of the present disclosure, the light guide includes the light guide portion and the protrusions. The light guide is disposed on the first frame by fitting the protrusions into the openings of the first frame. Therefore, the first frame is provided without an outer lateral wall since it is not necessary to dispose the light guide in an accommodation groove, thereby reducing the size of the illumination fan.

According to another aspect of the present disclosure, the second frame includes an inner surface which is substantially flat in some embodiments; any portion of the second frame is not located between the fan blade and the light guide in a radial direction of the illumination fan in some other embodiments; and there is no raised area on the inner surface of the second frame in still some other embodiments. A configuration of the second frame is favorable for preventing the accommodation groove, where the light guide is located, from being occupied by the second frame. Besides, the light source can be disposed on the inner surface of the second frame. Therefore, a smaller radial size and better appearance of the illumination fan are obtained.

The embodiments are chosen and described in order to best explain the principles of the present disclosure and its practical applications, to thereby enable others skilled in the art to best utilize the present disclosure and various embodiments with various modifications as are suited to the particular use being contemplated. It is intended that the scope of the present disclosure is defined by the following claims and their equivalents.

What is claimed is:

1. An illumination fan, comprising:

a first frame comprising an accommodation space;

a second frame assembled with the first frame, and an inner surface of the second frame being substantially flat;

a fan blade rotatably disposed in the accommodation space;

a light source disposed on either the first frame or the second frame; and a light guide disposed on the first frame and surrounding the fan blade;

wherein the first frame comprises a first lateral wall, the light guide is disposed on the first lateral wall, the light guide comprises a plurality of light guide portions and a plurality of protrusions, the light guide portions are assembled with each other, the protrusions are respectively located on lateral sides of the light guide portions facing toward the fan blade, a plurality of openings of the first lateral wall of the first frame are arranged in a circumferential direction of the illumination fan, and the protrusions of the light guide are respectively fitted into the openings of the first lateral wall.

2. The illumination fan according to claim 1, wherein the second frame comprises a frame body and an assembling structure, the frame body comprises the inner surface, the assembling structure is located on the inner surface, and the first frame is assembled with the second frame by the assembling structure.

3. The illumination fan according to claim 1, wherein any portion of the second frame is not located between the fan blade and the light guide in a radial direction of the illumination fan.

4. The illumination fan according to claim 2, wherein the assembling structure is disposed nearby a periphery of the frame body, and the inner surface of the frame body faces toward the fan blade.

5. The illumination fan according to claim 2, wherein the inner surface of the frame body extends from a center of the frame body to a periphery of the frame body.

6. The illumination fan according to claim 2, wherein the frame body comprises an annular portion and a rib portion connected to each other, the assembling structure is disposed on the annular portion, the fan blade is disposed on the rib portion, and an inner surface of the annular portion and an inner surface of the rib portion jointly define the inner surface of the frame body.

7. The illumination fan according to claim 1, wherein the first frame further comprises a second lateral wall connected to the first lateral wall, the first lateral wall is closer to the fan blade than the second lateral wall, the first lateral wall and the second lateral wall jointly define an accommodation groove, and the light guide is disposed in the accommodation groove.

8. The illumination fan according to claim 7, wherein the light source is disposed on the first frame and in the accommodation groove.

9. The illumination fan according to claim 8, wherein the light source is located between the light guide and the second lateral wall.

10. An illumination fan, comprising:

a first frame comprising an accommodation space;

a second frame assembled with the first frame, and an inner surface of the second frame being substantially flat;

a fan blade rotatably disposed in the accommodation space;

a light source disposed on either the first frame or the second frame; and a light guide disposed on the first frame and surrounding the fan blade;

wherein the first frame comprises a first lateral wall, the light guide is disposed on the first lateral wall, the light guide comprises a plurality of light guide portions and a plurality of protrusions, the light guide portions are assembled with each other, the protrusions are respectively located on lateral sides of the light guide portions facing toward the fan blade, a plurality of openings of the first lateral wall of the first frame are arranged in a circumferential direction of the illumination fan, and the protrusions of the light guide are respectively fitted into the openings of the first lateral wall.

* * * * *